US005683315A

United States Patent [19]

Ring

[11] Patent Number: 5,683,315

[45] Date of Patent: Nov. 4, 1997

[54] PORTABLE TETHERED BALL BATTING PRACTICE APPARATUS

[76] Inventor: David Lee Ring, 9955 Pibroch La., Wilton, Calif. 95693

[21] Appl. No.: 707,850

[22] Filed: Sep. 9, 1996

[51] Int. Cl.[6] ..... A63B 69/00

[52] U.S. Cl. ..... 473/429; 473/330

[58] Field of Search ..... 273/26 E, 29 A, 273/58 C, 413; 473/138, 139, 423, 422, 426, 393, 429, 430, 147, 108, 115

[56] References Cited

U.S. PATENT DOCUMENTS

| | | | |
|---|---|---|---|
| 2,058,277 | 10/1936 | Walther . | |
| 2,976,040 | 3/1961 | Bales . | |
| 3,425,700 | 2/1969 | Edwards . | |
| 3,626,502 | 12/1971 | Weil . | |
| 3,652,088 | 3/1972 | Marsh . | |
| 3,731,926 | 5/1973 | Vincent . | |
| 3,994,494 | 11/1976 | Kelley . | |
| 4,451,036 | 5/1984 | Sinclair et al. . | |
| 4,647,042 | 3/1987 | Bruce . | |
| 4,674,744 | 6/1987 | Walsh | 273/26 E |
| 4,815,735 | 3/1989 | McClenny . | |
| 4,872,675 | 10/1989 | Crowden . | |
| 4,881,742 | 11/1989 | Hargrave | 273/81 |
| 4,964,634 | 10/1990 | Boyer . | |
| 5,000,450 | 3/1991 | Beintema . | |
| 5,056,781 | 10/1991 | Preston et al. . | |
| 5,271,618 | 12/1993 | Malwitz . | |
| 5,374,056 | 12/1994 | Scher | 273/26 E |
| 5,460,364 | 10/1995 | Ring . | |

*Primary Examiner*—Theatrice Brown
*Attorney, Agent, or Firm*—James M. Ritchey

[57] ABSTRACT

A portable ball batting practice apparatus for attachment to a pre-existing support includes an elongated member having two ends. The elongated member is attached at one of its ends to two tethers. The first tether is resilient and the second tether is a fixed-length tether. Both ends of the two tethers not attached to the elongated member are secured to a single ball. Incorporated into the elongated member is a releasable anchoring system for attaching the elongated member to the support.

4 Claims, 2 Drawing Sheets

PORTABLE TETHERED BALL BATTING PRACTICE APPARATUS

BACKGROUND OF THE INVENTION

1. Field of the Invention

A training apparatus for assisting a user in developing ball batting skills is provided. More particularly, the apparatus releasable secures to an existing support and includes an arm member having a ball that is attached to the arm by both resilient and fixed-length tethers.

2. Description of the Background Art

Several related devices have been found in the prior art that comprise ball hitting trainers. However, these devices are rather complex structurally and incorporate self supporting elements or do not provide a moving pitch.

A device currently on the market merely supplies of ball tethered by a freely rotating pivot joint to the end of a horizontal support. The energy imparted to the ball by the hit is dissipated in spinning the ball in a constant radius circle about the pivot joint and no return pitch is delivered.

More particularly, described in U.S. Pat. No. 2,058,277 is a baseball practice machine that includes a motor-driven rotating arm. Connected to the rotating arm is a rubber cord fastened to a ball. Hitting the ball merely extends the cord for a period of time.

A practice tether ball device is presented in U.S. Pat. No. 2,976,040. A flexible cable is affixed to a rotating hub. Upon hitting the ball the ball and cord spin about the hub until the imparted energy is dissipated.

Supplied in U.S. Pat. No. 3,425,700 is a golf practice device having a vertical support and a downwardly angle arm to which a tether and ball are connected. Hitting the golf ball produces a free rotation of the tether and ball about the tether to arm connection point.

Disclosed in U.S. Pat. No. 3,626,502 is a tethered ball for baseball batting practice. Comprising the device is a stake having an internal spring that is fastened to one end of a tether. A ball is fastened to the other end of the tether.

U.S. Pat. No. 3,652,088 discloses a tethered ball baseball batting practice device. A tethered ball is slidably engaged with an upwardly sloping cable. When the ball is hit it slides up the cable until the imparted energy is spent and then slides back down into an initial position.

A training device including a captive ball to be struck by a game club is specified in U.S. Pat. No. 3,731,926. A ball is fastened to a spring return mechanism. Upon hitting the ball the ball deflects and is repositioned in the initial location by the spring return mechanism.

U.S. Pat. No. 3,994,494 relates a tethered ball baseball practice having a tethered ball that deflects into a net upon hitting. After the energy of the hit is absorbed in the net, the ball returns to hang in its initial position.

U.S. Pat. No. 4,451,036 reports a batting practice device that holds a ball in a releasable position for hitting. Upon hitting the ball the ball is projected from within the held position and forward. The ball is not tethered to the device.

Related in U.S. Pat. No. 4,815,735 is a pitching machine having a tethered ball that is secured to a horizontal arm that is part rigid and part semi-rigid. The arm is attached to a vertical support member. A motion damping mechanism is included.

A sports training device is presented in U.S. Pat. No. 4,647,042. A weighted base member extends into an adjustable vertical support. Attached to the top of the vertical support is a horizontal arm that terminates in a tether that is secured to a ball.

U.S. Pat. No. 4,872,675 describes a baseball pitching device having a base support and a rotating arm attached to the base. The arm has a tethered ball anchored to one end and a counter weight at the other end. Means are supplied for rotating the arm relative to the base support to produce a moving ball to strike.

Disclosed in U.S. Pat. No. 4,964,634 is a tethered ball batting practice device comprising a ball secured to a two-part tether having a cord section and a resilient section. The end of the resilient section is mated to a stake that has a backup anchor.

A tethered ball batting practice device is presented in U.S. Pat. No. 5,000,450. A ball is tethered to a freely rotating hub. The hub is secured to an arm which is releasably fastened to a vertical support. Hitting the ball produces rotation about the hub until the energy is spent.

U.S. Pat. No. 5,056,781 discloses a tethered ball pitching apparatus including an elastic cord anchored to a ball. The cord is attached to an elevated bracket. The device is positioned between a batter and a pitcher.

U.S. Pat. No. 5,271,618 communicates a batting practice device having a tethered ball that is attached to a rotating hub. The hub is connected to a bracket that anchors to a fence of other equivalent support. Hitting the ball produces free rotation of the ball and tether about the hub.

Described in U.S. Pat. No. 5,460,364, issued to the subject inventor Ring, is a portable ball batting practice apparatus that comprises many of the current invention's elements except that no fixed-length tether is utilized to limit the amount of energy stored after hitting the ball in the wrapping of the resilient tether around the elongated member. Although the device related in U.S. Pat. No. 5,460,364 is a very useful practice apparatus, the introduction of the critical fixed-length tether greatly improves usage of the subject device.

SUMMARY OF THE INVENTION

An object of the present invention is to provide an inexpensive, easily transported, and easy to set up ball batting practice apparatus.

Another object of the present invention is to disclose a ball batting practice apparatus that includes a ball affixed by two tethers, one resilient and the other of fixed-length, to a horizontal support.

Still another object of the present invention is to make known a ball batting practice apparatus that provides a moving target to hit.

Yet a further object of the present invention is to supply a ball batting practice apparatus that utilizes the force the batter exerts, limited by a fixed-length tether, to energize the apparatus for the next pitch and therefore requires no electricity to deliver a pitch-like target ball to a hitter.

Yet another object of the present invention is to provide a ball batting practice apparatus that by varying the length of the fixed-length tether permits weak and strong hitters to utilize the same basic device for practice.

Still yet another object of the present invention is to disclose a ball batting practice apparatus that is easily supported by pre-existing supports that are found at standard ball practice areas.

Still a further object of the subject invention is to make it easy for one person to operate and obtain many pitches in a short amount of time without the necessity of a new setup before each pitch.

Disclosed is a portable ball batting apparatus for attachment to a pre-existing support. The subject apparatus comprises an essentially hollow elongated member having first and second ends and an interior space. A support contacting plate is attached to the elongated member second end as is a support anchoring strap. A resilient tether having first and second ends is attached by the tether's first end to the elongated member by releasable means (the releasable means is usually and simply accomplished by knotting the end of tether on the inner side of a hole in the support) and a ball is secured to the tether's second end. A fixed-length tether is included to function as a limiter to prevent unlimited stretch of the resilient tether. Provided are means for anchoring the elongated member second end to the support, wherein the support is releasable secured between the support contacting plate and the anchoring strap. Preferably, the anchoring means is a "come-along" or ratchet with a handle that employs standard means of teeth engaging a pawl in the strap tightening process. Further, the support contacting plate usually has a resilient surface coating that contacts the support for added frictional interaction and minimizes possible damage to the pre-existing support's.

Other objects, advantages, and novel features of the present invention will become apparent from the detailed description that follows, when considered in conjunction with the associated drawings.

DESCRIPTION OF THE PREFERRED EMBODIMENT

Figure 1:
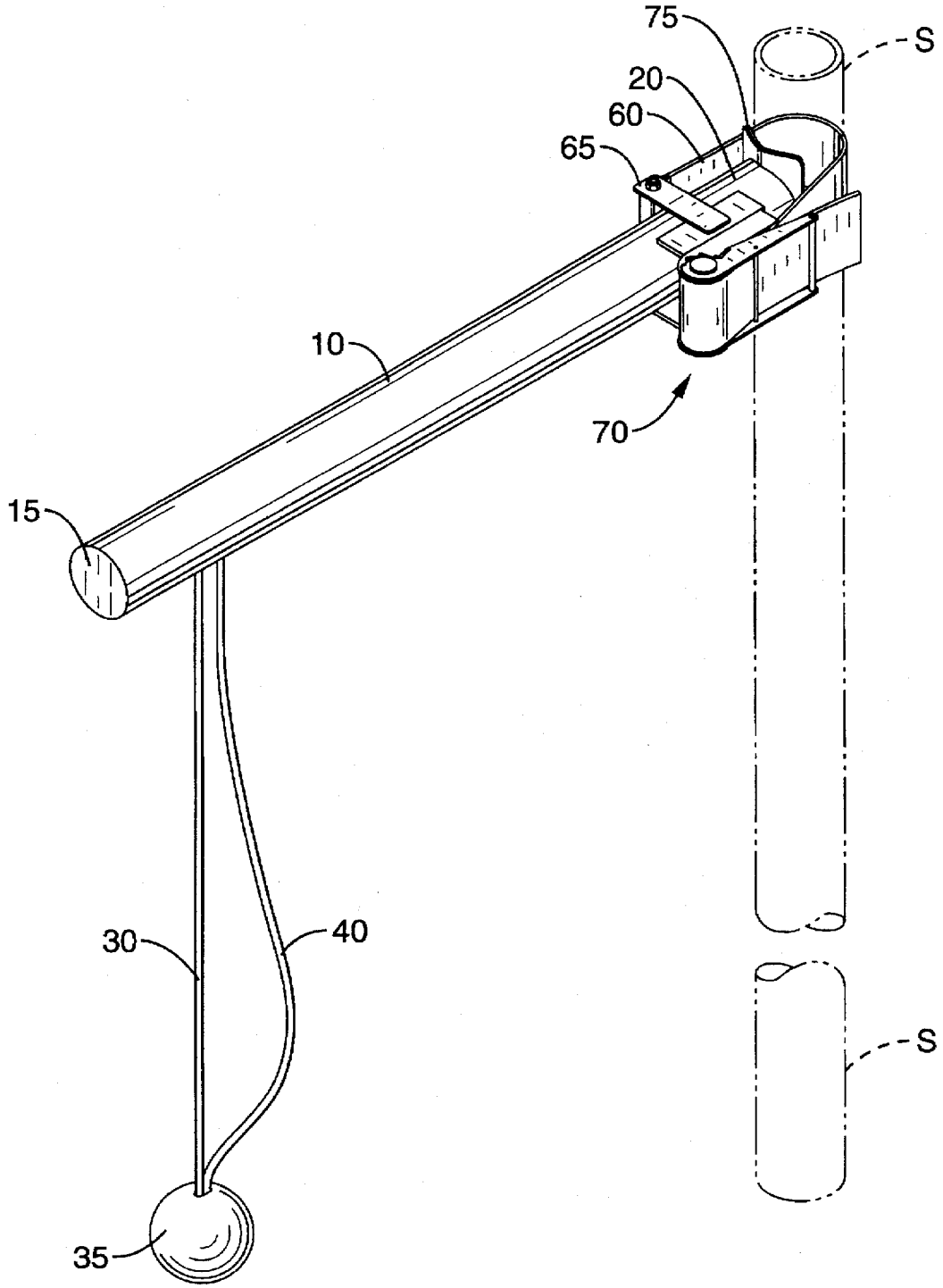
FIG. 1 is a perspective view of the subject invention showing attachment to a pre-existing vertical support.

Referring now to FIGS. 1–2, there is shown a preferred embodiment of a portable ball batting practice apparatus that attaches to a support S. Usually, the support S is a vertical or horizontal fence post or similar structure that is found in a pre-existing form at a ball practice location and is not built or installed for each practice session with the subject invention. Most ball practice areas have vertical fence posts that are ideal attachment sites for the subject apparatus. Since vertical fence posts are often about three feet to about six feet in height or greater, the subject device can be anchored at any desired height for a user.

Figure 2A:
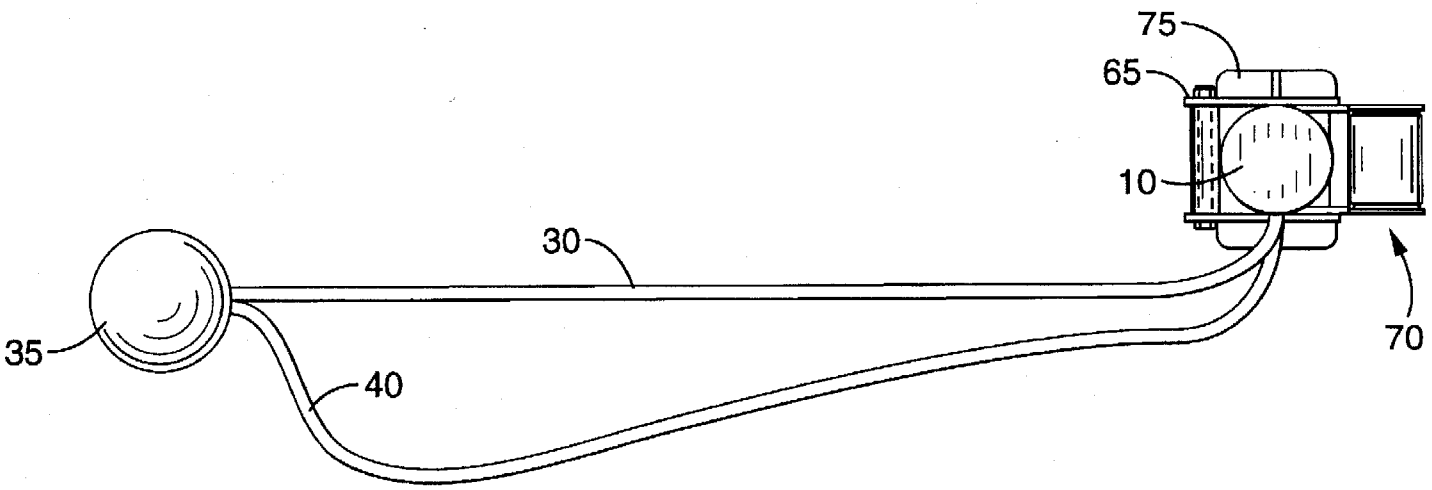
FIG. 2A is an end view of the subject invention showing the resilient tether in the relaxed state (immediately after being hit to the side).
Figure 2B:
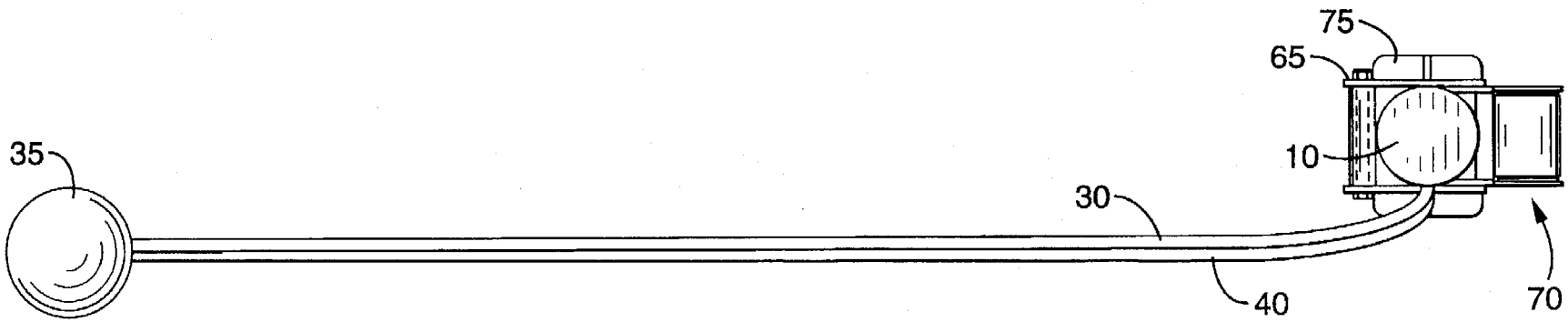
FIG. 2B is an end view of the subject invention showing the resilient tether in the extended state (before wrapping) with the fixed-length tether acting as a limiter preventing further extension of the resilient tether.

As illustrated in FIGS. 1, 2A, and 2B, component 10 is an essentially hollow elongated member 10 that serves as a central framework structural element for the subject apparatus. Normally, the elongated member 10 is fabricated from materials such as metal or natural or synthetic polymeric substances and is formed in a cylindrical structure. Other equivalent geometric configurations equivalent to a cylinder are contemplated to be within the realm of this disclosure. Usually, the elongated member 10 is rigid or semi-rigid, The elongated member 10 has first 15 and second 20 ends and is usually at least partially hollow with an interior space (not shown).

As seen in FIG. 1, a resilient tether 30 is secured at one end to the elongated member 10 first end 15 and by its other end to a ball 35. The resilient tether 30 may be coupled to the elongated member 10 by standard techniques such as passing the resilient tether through an aperture in the elongated member 10 and knotting the end of the resilient tether 30 to prevent removal. Other equivalent attachment means include anchoring pins with slots, hooks with eyelets, and the like. The attachment means for both tethers 30 and 40 to the elongated member 10 is by a fix-point attachment means that does not itself rotate and serves as an anchor point upon which the tethers 30 and 40 are secured to produce the wrapping action around the elongated member 10.

Fastened to the other end of the tether 30 is the ball 35. Standard means are envisioned to secure the ball 35 to the tether 30. The ball 35 is resilient and of conventional forms and sizes. Either permanent or replaceable ball securement means are contemplated. Such securement means comprise the tether 30 being integral with the ball 35 or associated in an appropriate manner to provide secure attachment during the delivered force of the batting process.

Preferably, the tether 30 is constructed from resilient materials that lengthen when a stretching force is applied. The resilient tether 30 provides a means for storing the energy of the batted ball when it wraps around the elongated member 10 after the ball is batted. The centrifugal force, due to the rotational velocity of the batted ball, creates tension in the tether causing it to stretch. After wrapping around the elongated member 10 in a slightly extended form, the stored energy causes the tether 30 to unwrap in a manner that swings the ball 35 into a moving target for the batter. Further, should the user desire a more or less resilient tether 30, the tether 30 is easily replaced with a new tether 30 having a different resilience. Regardless of the exact elasticity or resilience of the tether 30 the associated ball 35 rotates back to an unwrapped position with enough velocity to provide a pitch-like environment to the batter.

A second tether 40 has a fixed-length and acts as a limiter to prevent the resilient tether 30 from being extended too far after being hit. The fixed-length tether 40 prevents the resilient tether 30 from wrapping too tightly about the elongated member 10 and moderates the "pitching force" that is delivered when the ball 35 and tethers 30 and 40 unwrap to deliver a pitch to the batter. The length of the fixed-length tether 40 may be varied to suit any particular user. A beginning user may desire a shorter fixed-length tether and a more experienced user a longer fixed-length tether 40. The longer the length of the fixed-length tether 40 the more the resilient tether 30 will stretch and the more energy stored in wrapped or extended state. Clearly, the fixed-length tether 40 only establishes a maximum stretch for the resilient tether 30 and a hit that generates incomplete extension of the resilient tether 30 holds less potential energy for delivering a pitch to the batter. Also, the fixed-length tether 40 decreases the wear on the resilient tether 30 by limiting its stretching to a fixed amount.

Subject practice devices can be matched to any user by selecting suitable features of the two tethers 30 and 40. Users may suit their particular desires by selecting appropriate length and resiliency characteristic for the resilient tether 30 in combination with a proper length for the fixed-length tether 40.

Means for anchoring the elongated member 10 to the support S are provided. FIG. 1 shows one preferred anchoring means that includes means for tightening an anchoring strap 60 about the support S. The anchoring strap 60 is secured to the elongated member 10 via a bracket 65. The provided tightening means for securing the subject device to the support S is a "come-along" ratchet with handle 70. The ratchet with handle 70 mounts proximate to the elongated member's second end 20. The strap 60 is usually fabricated from nylon mesh or equivalent materials and is releasably bound by the ratchet with handle 70 by standard means. The ratchet with handle 70 is generally provided with a means for reversing the direction produced by motion of the handle to permit the user to tighten or loosen the strap 60. Other means for anchoring the elongated member 10 to the support S are contemplated to be within the scope of this disclosure and include, but are not limited to, threaded devices, lever and cam mechanisms, and the like.

As seen in FIG. 1, attached to the outside of the elongated member's 10 second end 20 is a support contacting plate 75. The plate 75 is usually rigid and is preferably coated with a resilient surface (not shown) that contacts the support S and provides additional frictional interaction between the support S and plate 75. Also, the resilient surface minimizes or eliminates scarring damage to the support's surface. Usually, the resilient surface coating is a polymeric substance like rubber or plastic or similar material.

Clearly, after the strap 60 is wrapped around the support S and releasable secured within the locking or anchoring means, then when the ratchet and handle 70 is utilized in an appropriate direction the plate 75 forces the support against the strap 60 and tightens the subject device to the support S. To release the strap the ratchet and handle 70 action is reversed.

FIGS. 2A and 2B illustrate the role or function of the fixed-length tether 40. FIG. 2A depicts the ball 35 and both tethers 30 and 40 of the subject device immediately before being hit by a user. In this "before-the-hit" situation, the resilient tether 30 is in a contract state. FIG. 2B shows the two tethers 30 and 40 immediately after the user hits the ball 35. In this "after-the-hit" situation, the resilient tether 30 is in an extended or stretched state in which its length is limited by the length of the fixed-length tether 40. Clearly, immediately after the state shown in FIG. 2B, the tethers 30 and 40 begin to wrap around the elongated member 10 to store the imparted energy.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A portable ball batting practice apparatus for attachment to a support, comprising:

a) an elongated member;

b) a resilient tether having first and second ends, wherein said resilient tether first end is secured to said elongated member at a connection point;

c) a fixed-length tether having first and second ends, wherein said fixed-length tether first end is secured to said elongated member proximate said connection point;

d) a ball, wherein said ball is secured to both said resilient and said fixed-length tether second ends; and e) means for anchoring said elongated member to the support.

2. A portable ball batting practice apparatus for attachment to a pre-existing support, comprising:

a) a hollow elongated member having first and second ends;

b) a resilient tether having first and second ends;

c) a fixed-length tether having first and second ends;

d) means for attaching said resilient and said fixed length tether first ends proximate to said elongated member first end;

e) a ball, wherein said ball is secured to both said resilient and said fixed-length tether second ends; and f) means for anchoring said elongated member second end to the support.

3. A portable ball batting practice apparatus according to claim 2, wherein said elongated member second end anchoring means comprises:

a) an anchoring strap associated with said elongated member second end and b) means for tightening said strap about the support.

4. A portable ball batting practice apparatus for attachment to a pre-existing support, comprising:

a) a hollow elongated member having first and second ends;

b) a support contacting plate attached to said elongated member second end;

c) an anchoring strap secured to said elongated member second end;

d) a resilient tether having first and second ends;

e) a fixed-length tether having first and second ends;

f) means for attaching said resilient and said fixed-length tether first ends to said elongated member;

g) a ball, wherein said ball is secured to both said resilient and said fixed-length tether second ends; and h) means for anchoring said elongated member second end to the support, wherein the support is releasable secured between said support contacting plate and said anchoring strap.

* * * * *